US011898437B2

(12) United States Patent
Xu et al.

(10) Patent No.: US 11,898,437 B2
(45) Date of Patent: Feb. 13, 2024

(54) METHOD AND SYSTEM FOR DETERMINING FLUID LEVEL CHANGE USING PRESSURE MONITORING OF ANNULAR GAS

(71) Applicant: SAUDI ARABIAN OIL COMPANY, Dhahran (SA)

(72) Inventors: Jianhui Xu, Dhahran (SA); Bodong Li, Dhahran (SA); Guodong Zhan, Dhahran (SA); Chinthaka P. Gooneratne, Dhahran (SA); Timothy Eric Moellendick, Dhahran (SA); Graham Hitchcock, Westhill (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/555,048

(22) Filed: Dec. 17, 2021

(65) Prior Publication Data

US 2023/0193745 A1 Jun. 22, 2023

(51) Int. Cl.

| | |
|---|---|
| ***E21B 47/047*** | (2012.01) |
| ***E21B 33/127*** | (2006.01) |
| ***E21B 33/06*** | (2006.01) |
| ***E21B 47/06*** | (2012.01) |

(52) U.S. Cl.

CPC ..... *E21B 47/047* (2020.05); *E21B 33/06* (2013.01); *E21B 33/127* (2013.01); *E21B 47/06* (2013.01)

(58) Field of Classification Search

CPC ..... E21B 47/047; E21B 47/06; E21B 33/06; E21B 33/127

See application file for complete search history.

(56) References Cited

U.S. PATENT DOCUMENTS

| | | | | |
|---|---|---|---|---|
| 5,094,102 | A | 3/1992 | Fryer et al. | |
| 5,168,932 | A * | 12/1992 | Worrall | G01F 1/007 175/48 |
| 5,285,388 | A * | 2/1994 | McCoy | G01F 23/2962 367/113 |
| 6,371,204 | B1 * | 4/2002 | Singh | E21B 21/00 175/48 |
| 6,705,397 | B2 | 3/2004 | Hershberger | |
| 8,417,483 | B2 | 4/2013 | Anderson et al. | |

(Continued)

FOREIGN PATENT DOCUMENTS

CN 103726834 A 4/2014

*Primary Examiner* — Yong-Suk (Philip) Ro

(74) *Attorney, Agent, or Firm* — Osha Bergman Watanabe & Burton LLP

(57) ABSTRACT

A method includes creating a chamber within an annulus between a wellbore casing and a drillpipe. An upper boundary of the chamber includes a seal and a lower boundary of the chamber includes a liquid surface and determining a volume of the chamber at a first time. The method further includes determining the volume of the chamber includes measuring, using a pressure gauge, a first pressure within the chamber, changing an amount of a gas in the chamber, and measuring, using the pressure gauge, a second pressure within the chamber. The method further includes determining a first volume of gas within the chamber based on the first and second pressure measurements and the change in the amount of gas, and determining a first fluid level based on the first volume of the chamber.

19 Claims, 7 Drawing Sheets

(56) References Cited

U.S. PATENT DOCUMENTS

| | | | | |
|---|---|---|---|---|
| 8,583,378 | B2 * | 11/2013 | Jacques | G01V 9/00 702/50 |
| 8,909,479 | B2 * | 12/2014 | Kvernvold | G01M 3/2807 73/40 |
| 10,060,208 | B2 * | 8/2018 | Gumus | E21B 47/06 |
| 10,570,725 | B2 * | 2/2020 | McCoy | E21B 47/06 |
| 2011/0125333 | A1 * | 5/2011 | Gray | E21B 21/08 175/48 |
| 2017/0298712 | A1 * | 10/2017 | Loomans | E21B 7/00 |
| 2020/0370427 | A1 * | 11/2020 | Peter | E21B 47/008 |
| 2021/0301631 | A1 | 9/2021 | Li et al. | |
| 2022/0098968 | A1 * | 3/2022 | Groover | E21B 47/06 |
| 2022/0365239 | A1 * | 11/2022 | Rose | E21B 49/00 |

* cited by examiner

METHOD AND SYSTEM FOR DETERMINING FLUID LEVEL CHANGE USING PRESSURE MONITORING OF ANNULAR GAS

BACKGROUND

Drilling a wellbore typically includes pumping a fluid, such as "drilling mud", down a string of connected hollow pipes, called a drillstring, and out of a drill bit attached to the lower end of the drillstring. The drilling mud then circulates out of the hole to the surface carrying pieces of drilled rock, known as "cuttings". The density of the drilling mud is carefully controlled to provide a wellbore pressure on the earth formation that is specifically designed for a given application. In most cases, the wellbore pressure is designed to be greater than the pressure of the formation fluids (e.g., water, hydrocarbons) contained in the drilled rock. As a result, the wellbore pressure prevents formation fluids from entering the annulus and being transported to surface.

In drilling operations, a fluid loss event can occur in situations where the hydrostatic pressure inside a wellbore is not maintained in a particular range, where the hydrostatic pressure may be greater than the formation pressure, but less than the fracture pressure. If the hydrostatic pressure in the wellbore exceeds the fracture pressure, fractures may be formed in the formation, leading to leakage of drilling mud or other fluids. Leakage of drilling mud is commonly referred to as "lost circulation". Lost circulation is a major cause of non-productive time (NPT) during drilling and increases the cost of drilling, since drilling fluid lost to the formation must be replaced.

The drilling industry has developed several techniques to fight losses. Lost circulation materials (LCM) may refer to any substance added to drilling fluids when drilling fluids are actively being lost to the formation to prevent or mitigate further loss. For example, the LCM may include gels, fibers, cement, or chemicals.

A fluid loss event is typically detected when the flow rate or pressure of returning drilling mud is less than expected. In some extreme lost circulation cases, there can be total mud loss, where there is no returning mud. Flow rate and pressure in returning pipes may be measured continuously, which can alert operators to a partial or total mud loss. If a total loss is not mitigated in a timely fashion, there is risk of the wellbore collapsing.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method. The method includes creating a chamber within an annulus between a wellbore casing and a drillpipe, wherein an upper boundary of the chamber comprises a seal and a lower boundary of the chamber comprises a liquid surface and determining a volume of the chamber at a first time. Determining the volume of the chamber includes measuring, using a pressure gauge, a first pressure within the chamber, changing an amount of a gas in the chamber, measuring, using the pressure gauge, a second pressure within the chamber, and determining a first volume of gas within the chamber based on the first and second pressure measurements and the change in the amount of gas. The method further includes determining a first fluid level based on the first volume of the chamber.

In another aspect, embodiments disclosed herein relate an apparatus, which includes a casing disposed within a wellbore and a drillpipe disposed within the casing, wherein an annulus is created between the casing and the drillpipe. The apparatus further includes a seal disposed in the annulus, a chamber, wherein an upper boundary of the chamber comprises the seal and a lower boundary of the chamber comprises a surface of a liquid, and a pressure gauge connected to the chamber.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-7, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure Disclosed herein are embodiments of apparatus and methods for measuring a downhole fluid level in an annulus. Such apparatus and methods may be used during a fluid loss event in order to assess the effectiveness of fluid loss mitigation methods. More specifically, embodiments disclosed herein relate to creating a chamber within an annulus, such that the amount of gas within the chamber may be changed and a corresponding pressure change may be calculated. From such a pressure change, a chamber volume may be calculated, which can, in turn, be used to calculate a fluid level.

Figure 1:
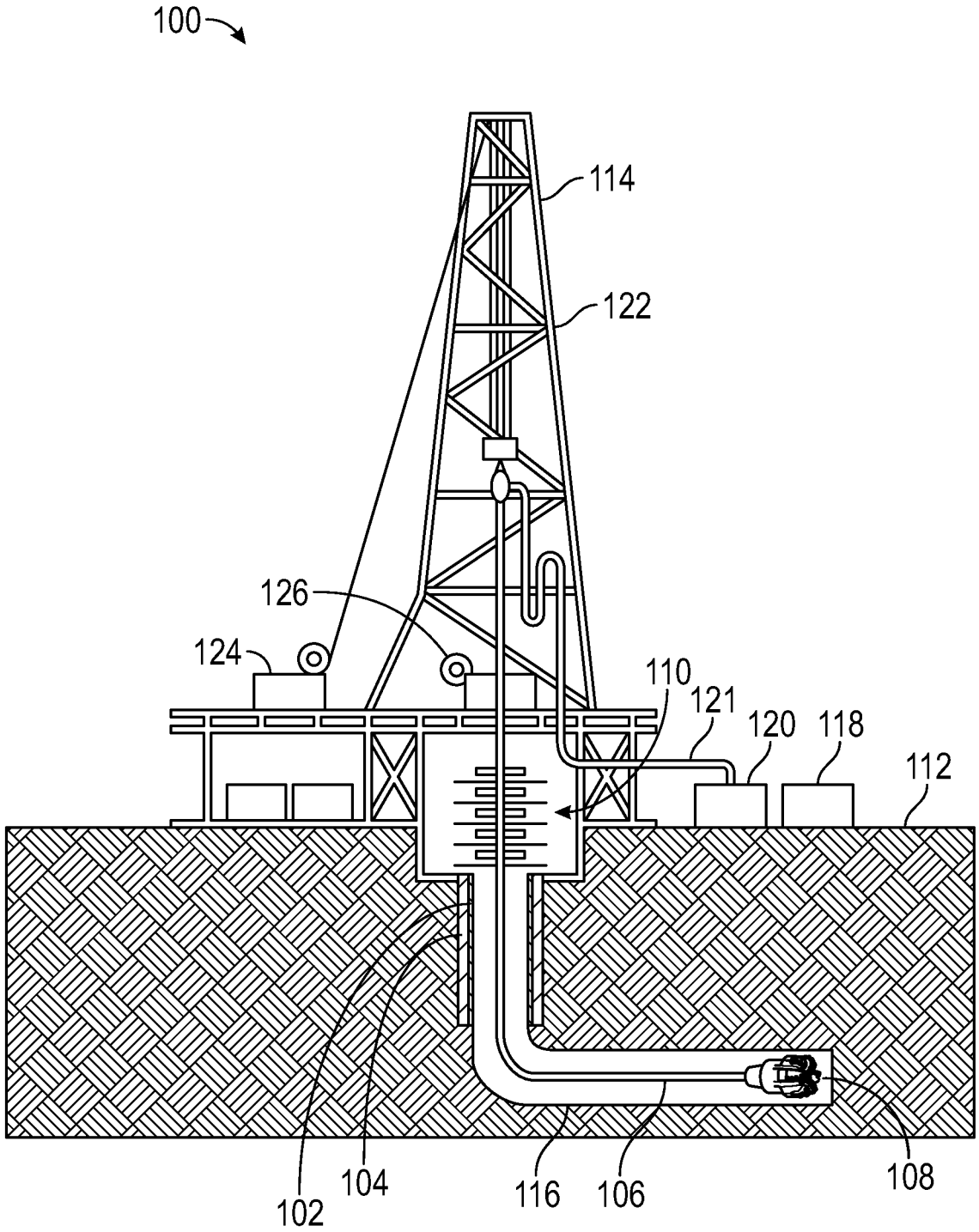
FIG. 1 shows an exemplary drilling system in accordance with one or more embodiments.

FIG. 1 depicts an exemplary drilling system 100 in accordance with one or more embodiments. The drilling system 100 includes a drilling rig 114 located on a surface 112 location that may be the surface of the earth (e.g., on land for onshore operations or on a rig platform for offshore operations). The drilling rig 114 refers to the machine used to drill a wellbore 116. Major components of the drilling rig 114 include the drilling fluid tanks 118, the drilling fluid pumps 120 (e.g., rig mixing pumps), the mud line 121, the derrick or mast 122, the draw works 124, the rotary table or top drive 126, the power generation equipment and auxiliary equipment. The drill bit 108 is attached to the drillpipe 106, which is connected to the drilling rig 114. Drilling fluid, also referred to as "drilling mud" or simply "mud," is used to facilitate drilling wellbores into the earth, such as oil and natural gas wells. The primary functions of drilling fluids include providing elevated pressure to prevent formation fluids from entering into the wellbore, keeping the drill bit 108 cool, clean, and lubricated during drilling, carrying out drill cuttings, and suspending the drill cuttings while drilling is paused and when the drilling assembly is brought in and out of the borehole.

As the wellbore 116 is drilled, sections of the wellbore 116 may be cased. At intervals during the drilling of the wellbore 116, drilling may be paused, the drill bit 108 and drillstring may be removed from the wellbore 116 and casing 102 may be inserted into the wellbore 116. Casing 102 is composed of sections of pipe with outer diameters slightly smaller than the diameter of the wellbore 116. The sections of casing 102 may be screwed together at the surface as they are inserted into the wellbore 116. Depending on the depth of the wellbore 116 and other operating parameters, multiple strings of casing 102 may be used to case the wellbore 116. Each successive string of casing 102 may be lowered into the wellbore 116 and connected to an end of a previously installed casing 102 or extend to the surface 122. Each successive string of casing 102 decreases in both outer diameter and inner diameter. After a string of casing 102 is lowered into the wellbore 116, cementing operations may be performed where liquid cement 104 is pumped down the interior of the casing to the depth at which drilling has halted, which may refer to the bottom of the wellbore 116. At this point, drill mud is pumped down the interior of the casing to displace the cement into the annulus. The annulus may refer to either the space between a casing 102 and the wellbore 116, or the space between two casings 102. A cement plug may be deployed between the liquid cement and the displacing drill mud to prevent mixing of the drilling mud and the cement. Once in the annulus, the liquid cement 104 may solidify and set.

A blowout preventer (BOP) 110 may be installed at the top of the wellbore 116. A blowout preventer 110, as one skilled in the art will be aware, refers to an array of one or more large valves at the top of the wellbore 116 that may be closed if the drilling crew loses control of formation fluids. Closing the valve may allow the drilling crew to regain control of the reservoir and mud density can be increased until the BOP may be safely opened, and pressure control of the formation may be retained.

Figure 2:
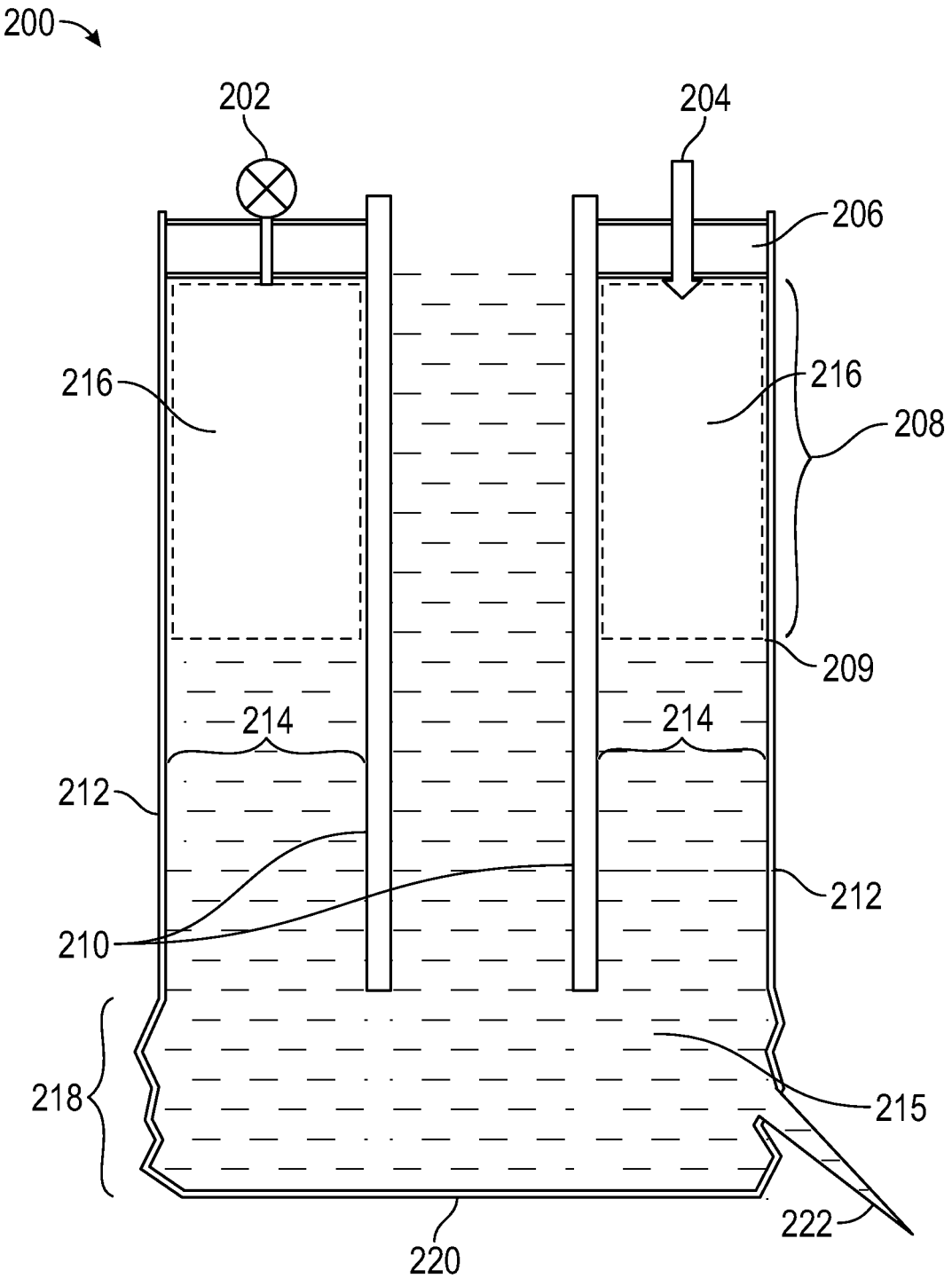
FIG. 2 shows an annular pressure change apparatus in accordance with one or more embodiments.

Turning now to FIG. 2, FIG. 2 shows an annular sealing apparatus in accordance with one or more embodiments. A drillpipe 210 may be disposed within a casing 212, such that an annulus 214 is created. A seal 206 may be disposed in the annulus 214 such that fluid, whether liquid or gas, may not flow from the portion of the annulus 214 below the seal 206 to the portion of the annulus 214 above the seal 206, or vice versa. A liquid, such as drilling mud 215, may be disposed within the annulus 214, such that a liquid surface 209 demarking the top of the liquid within the annulus 214 exists. Air, or another gas, may be present in the portion of the annulus 214 above the liquid surface 209 and below the seal 206. This portion of the annulus 214 may be called a chamber 216. During a fluid loss event, the position of the liquid surface 209 may be variable inside the annulus 214. The seal 206 forms an upper boundary of the chamber 216 and the liquid surface 209 forms a lower boundary of the chamber 216. The fluid level 208 describes the axial distance between the seal 206 and the liquid surface 209 disposed within the annulus 214. A pressure gauge 202 may be disposed on the seal 206 and the pressure gauge 202 may be used to measure the gas pressure within the chamber 216. A gas, such as air, may be pumped through a conduit 204 penetrating the seal 206 into the chamber 216.

The uncased portion 218 of the wellbore 116 may be called the openhole section 218 of the wellbore 116, and the lower surface 220 of the wellbore 116 may be called the bottom hole 220. If the formation is particularly porous, fluid loss may occur in openhole 218 portions of the wellbore 116, where drilling mud 215 may leak into the formation through the formation pores. Further, fractures 222 may be present in the formation. Fractures 222 may be preexisting natural fractures or may be created if the pressure within the wellbore 116 exceeds the formation fracture pressure. When fractures 222 form in the formation, drilling mud 215 may be lost to the formation through the fractures 222.

Figure 3:
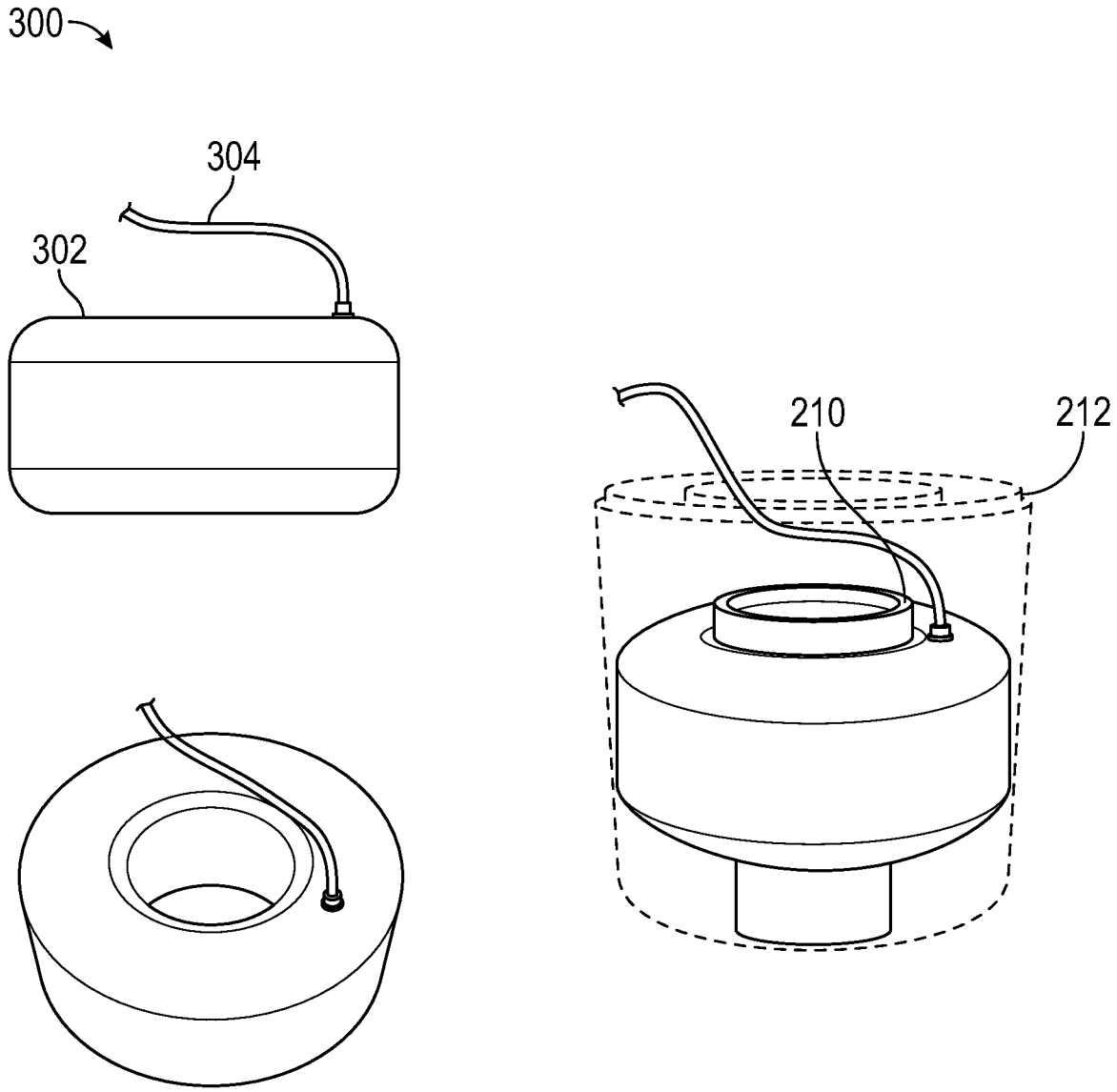
FIG. 3 shows an inflatable packer seal in accordance with one or more embodiments.

In one or more embodiments, as shown in FIG. 3, the seal 206 may be an inflatable packer 302. The inflatable packer 302 may be disposed within the annulus 214 and expanded via the inflator tube 304 such that it fits snugly between an outer diameter of the drillpipe 210 and an inner diameter of the casing 212. In such embodiments, an inner diameter of the inflated packer 302 may be equal to the outer diameter of the drillpipe 210, and an outer diameter of the inflated packer 302 may be equal to the inner diameter of the casing 212.

Figure 4:
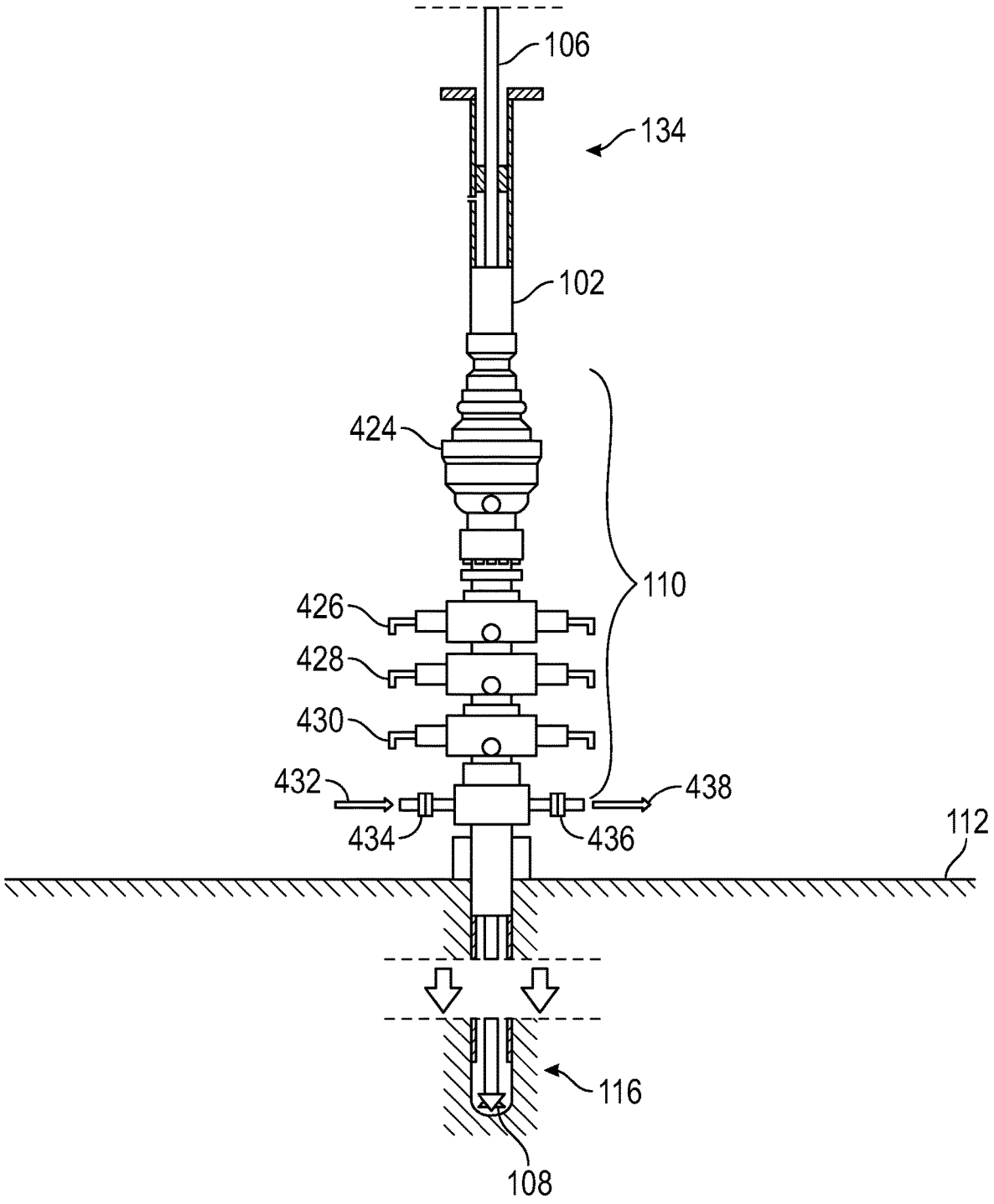
FIG. 4 shows a blowout preventer in accordance with one or more embodiments.

In other embodiments, the seal 206 may be formed by a blowout preventer (BOP) 110, as shown in FIG. 4. More specifically, FIG. 4 shows a section of the drilling system 100 known as a tree 134, which is located between the derrick 122 and the surface 112. Referring to FIGS. 2 and 4, the BOP 110 may be installed where the annulus 214 meets the surface 112 of the Earth. When one or more of the valves within the BOP 110 are closed, a seal 206 and a chamber 216 may be formed, wherein an upper boundary of the chamber 216 is the closed valve of the BOP 110 and a lower boundary of the chamber 216 is the liquid surface 209. The BOP 110 may be installed in line with the casing 102 and may include a number of specific BOP subtypes. For example, one or more annular blowout preventers 424 and one or more ram blowout preventers 426-430 may be installed in order to manage pressures within the wellbore 116. A manual kill valve 434 and a manual choke valve 436 may seal the annulus 214. In one or more embodiments, a pressure gauge 202 may be installed on a choke line 438. In such embodiments, the pressure gauge 202 may be a digital pressure gauge that samples the pressure at a high sample rate. Additionally, in one or more embodiments, gas 204 may be pumped into the chamber 216 through a kill line 432.

Figure 5:
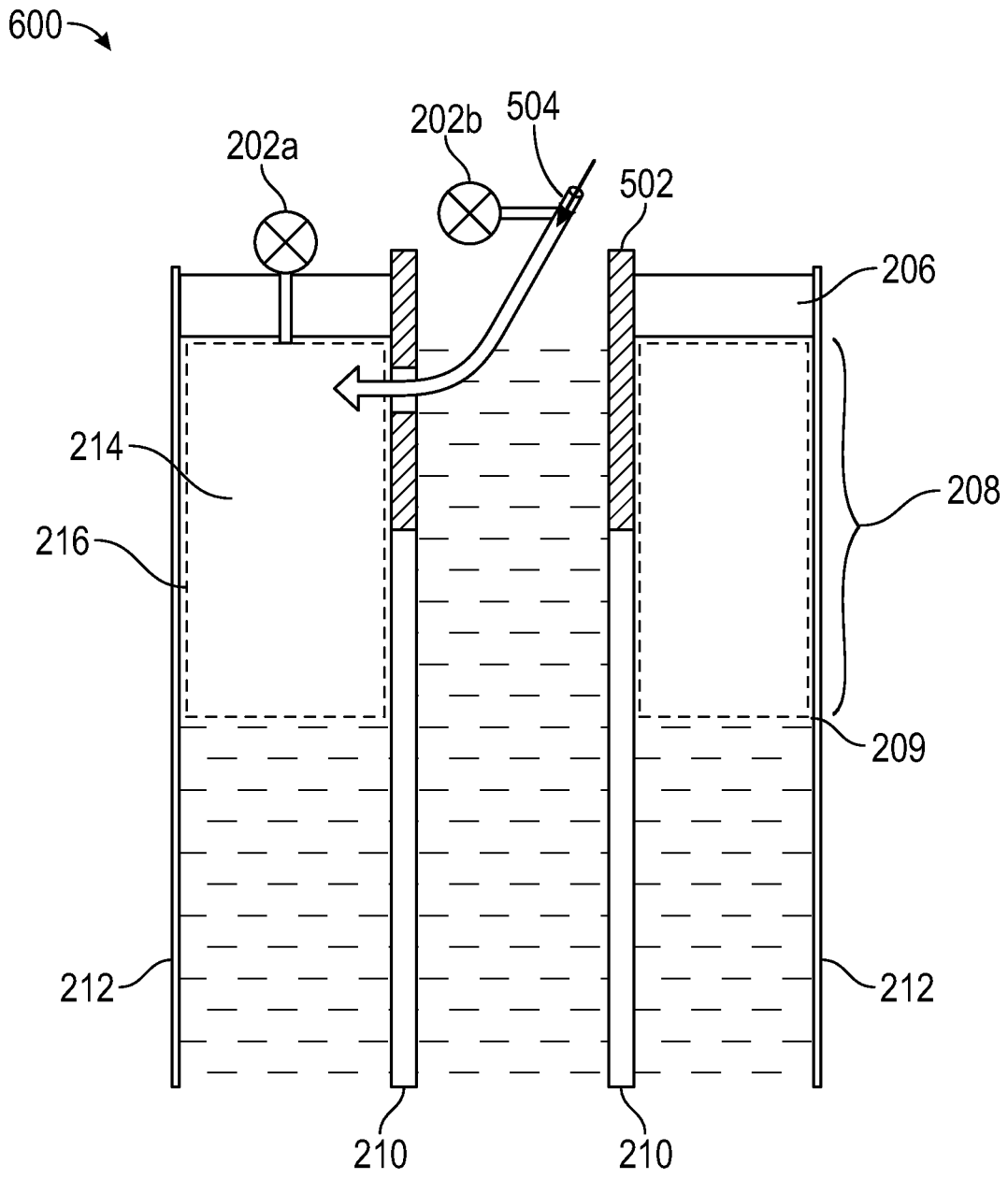
FIG. 5 shows an annular pressure change apparatus in accordance with one or more embodiments.
Figure 6:
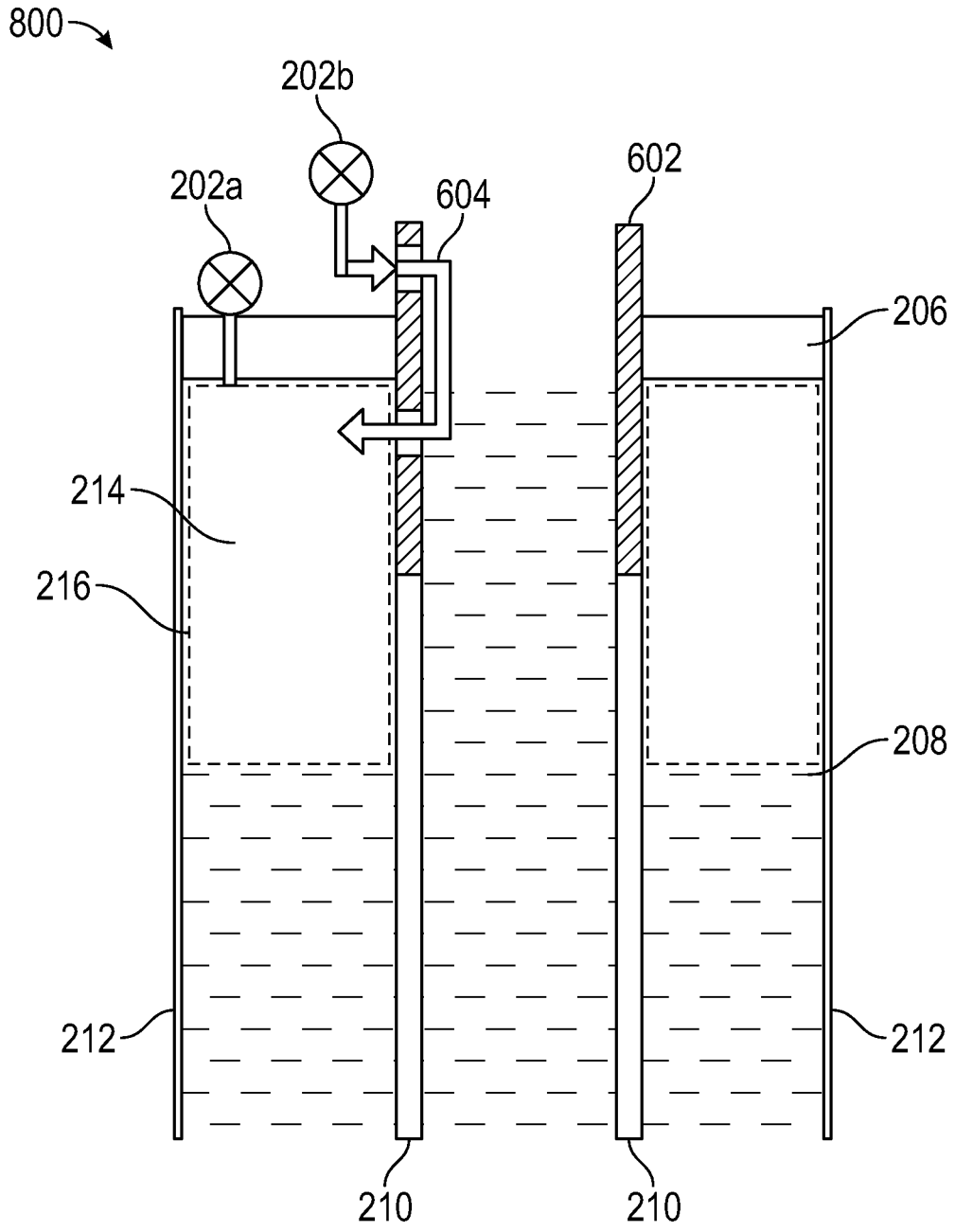
FIG. 6 shows an annular pressure change apparatus in accordance with one or more embodiments.

FIGS. 5 and 6 show examples of an annular pressure change apparatus in accordance with one or more embodiments. In some embodiments, as shown in FIG. 5, the seal 206 may be a BOP 110 and a first specialized drillpipe section 502 may be coaxially connected to the drillpipe 210 and inserted through the BOP 110. The first specialized drillpipe section 502 may be connected to the drillpipe 210 by any connection method commonly utilized in the field, such as a threaded connection. In one or more embodiments, as shown in FIG. 5, a flexible gas hose 504 may be attached to the first specialized drillpipe section 502 at one location, such that gas may be pumped through the flexible gas hose 504 directly into the annulus 214. In some embodiments, as shown in FIG. 5, the pressure gauge 202*a* may be incorporated into the BOP 110. In other embodiments, the pressure gauge 202*b* may be attached to the flexible gas hose 504.

In some embodiments, as depicted in FIG. 6, the flexible gas hose 504 may be replaced with a hard conduit 604, which may be attached to a second specialized drillpipe section 602 at two locations. In some embodiments, the pressure gauge 202*a* may be integrated with the BOP 110. In other embodiments, the pressure gauge 202*b* may be connected to the hard conduit 604.

Figure 7:
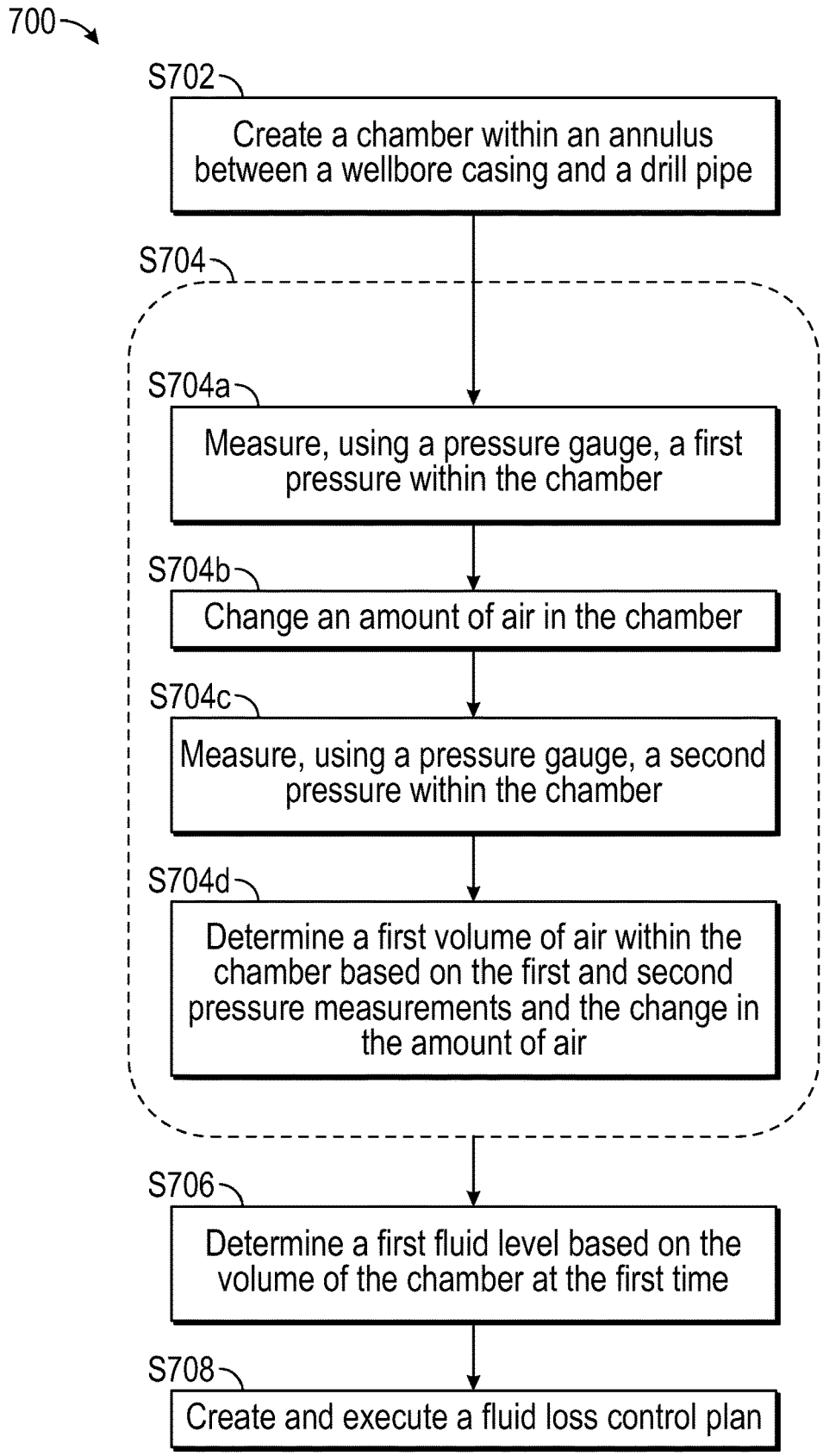
FIG. 7 shows a flowchart of a method in accordance with one or more embodiments.

Turning now to FIG. 7, FIG. 7 shows a flowchart 700 of a method in accordance with one or more embodiments. FIG. 7 describes a method of determining a fluid level 208 in an annulus 214 during a fluid loss event. Further, one or more blocks in FIG. 7 may be performed by one or more components as described in FIGS. 1-6. While the various blocks in FIG. 7 are presented and described sequentially, one of ordinary skill in the art will appreciate that some or all of the blocks may be combined, and some or all of the blocks may be executed in parallel. Furthermore, the blocks may be performed actively or passively.

Initially, in S702, a chamber 216 is created within an annulus 214. The annulus 216 may refer to the space between a casing 212 and a drillpipe 210, where the drillpipe 210 is set within the casing 212. However, the method described in flowchart 700 may be applied to any wellbore 116 where one casing string is set within another casing string, creating an annular region between the two strings. A seal 206 may be disposed within the annulus 216, where the seal 206 serves as an upper boundary of the chamber 216. In one or more embodiments, the seal 206 may be an inflatable packer 302. In other embodiments, a blowout preventer (BOP) 110 may provide the seal 206. A liquid surface 209 may serve as a lower boundary of the chamber 216.

In S704, in accordance with one or more embodiments, the volume of gas within the chamber 216 may be determined at a first time. In step S704*a*, a first pressure of the chamber 216 may be measured with a pressure gauge 202. In S704*b*, an amount of gas within the chamber 216 may be changed, such that a pressure change occurs. In some embodiments, the amount of gas may be changed by pumping gas into the chamber 216. In other embodiments, the amount of gas may be changed by pumping gas out of the chamber 216. In one or more embodiments, gas may be pumped into the chamber 216 through conduit 204 penetrating the seal 206. In other embodiments, where a blowout preventer 110 serves as the seal 206, gas may be pumped into the chamber 216 via a kill line 432. In further embodiments, a first specialized drillpipe section 502 may be coaxially connected to the drillpipe 210, such that a flexible gas hose 504 may be attached to the first specialized drillpipe section 502 at one location and gas may be pumped directly into the chamber. In further embodiments, a second specialized drillpipe section 602 may be coaxially connected to the drillpipe 210 and a hard conduit 604 may be attached to the second specialized drillpipe section 602 in two locations. In such embodiments, gas may be pumped into the chamber 216 directly through the hard conduit 604. In one or more embodiments, changing an amount of gas may refer to pumping gas out of the chamber 216. In some embodiments, the pressure gauge 202 may be disposed on the seal 206. In other embodiments, where a blowout preventer 110 serves as the seal 206, the pressure gauge 202 may be installed on a choke line 438. In some embodiments, the pressure gauge 202 may be a digital, high-frequency gauge. However, any type of pressure gauge 202 may be used without departing from the scope of this disclosure. In further embodiments, including those where a first specialized drillpipe section 502 and a flexible gas hose 504 are implemented, the pressure gauge 202 may be disposed on the flexible gas hose 504.

In S704*c*, a second pressure change within the chamber 216 may be measured at a second time, which may be separated from the first time by a non-zero time interval. The second pressure change may be measured using a pressure gauge 202, which may be installed in the system in a variety of locations. In some embodiments, this may be the same pressure gauge 202 used to measure the first pressure.

In S704*d*, a volume of gas within the chamber 216 may be determined based on the first and second pressure measurements and the change in the amount of gas. Pressure, as one skilled in the art will be aware, may be calculated using the ideal gas equation:

$$P = \left(\frac{RT}{V}\right)n, \qquad \text{Equation (1)}$$

where P is the pressure within the chamber 216, R is the universal gas constant, T is the ambient atmospheric temperature, V is volume of gas within the chamber 216, and n is the moles of gas in the chamber 216. n may be defined as:

$$n = n_0 + \Delta n, \qquad \text{Equation (2)}$$

where $$\Delta n = \left(\frac{tQP_0}{RT}\right), \quad \text{Equation (3)}$$

where $\Delta n$ is the moles of gas pumped into or out of the chamber 216, $n_0$ is the initial moles of gas in the chamber 216 before the amount of gas is changed, t is time during which the amount of gas is changed, Q is the volumetric pump rate, and $P_0$ is ambient atmospheric pressure.

Combining Equations 2 and 3 gives:

$$P = \left(\frac{RT}{V}\right)\left(\frac{tQP_0}{RT}\right), \quad \text{Equation (4)}$$

that may be further simplified to:

$$P = \frac{P_0 Qt}{V}. \quad \text{Equation (5)}$$

In situations, such as embodiments which method 700 applies to, where a pressure change over a given period of time is required in place of a discrete pressure value, P may be replaced by $\Delta P$, where $\Delta P$ is the pressure change. Similarly, t may be replaced with $\Delta t$, where $\Delta t$ is the non-zero time interval over which the pressure change occurred. Making these substitutions and rearranging in order to find volume, Equation 5 becomes:

$$V = \frac{P_0 Q \Delta t}{\Delta P}. \quad \text{Equation (6)}$$

In S704*d*, in accordance with one or more embodiments, Equation 6 may be used to determine the volume of gas in the chamber 216. From the volume of gas, a fluid level 208 may be determined, where the fluid level 208 is the axial distance between the upper boundary and lower boundary of the chamber 216. As such, the following general equation for the volume of a cylinder may be applied to determine the fluid level 208:

$$V_C = \pi r^2 h, \quad \text{Equation (7)}$$

where $V_C$ is the volume of a cylinder, r is the radius of the cylinder, and h is the height of the cylinder. Applying Equation 7 to the chamber 216, the following equation may provide the fluid level 208:

$$h = \frac{V}{\pi(r_C^2 - r_D^2)}, \quad \text{Equation (8)}$$

where h is the fluid level 208, $r_C$ is the radius of the casing 212, $r_D$ is the radius of the drillpipe, and V is the volume of the chamber 216.

Steps S704 and S706 may be repeated throughout a fluid loss event to monitor changes in fluid level 208 and to determine if a fluid loss, which may be the difference between two fluid level values, has occurred. In S708, continuous monitoring of fluid level 208 allows for the creation and execution of a fluid loss control plan, as well as allowing operators to assess the success of implemented mitigation methods. In one or more embodiments, a fluid loss control plan may involve pumping a substance, which may be a plugging material, downhole. In some embodiments, the plugging material may be a gel. In other embodiments, the plugging material may be a powdered agent. A plugging material may create a blockage such that fluid is unable to escape to the formation. Plugging may be temporary or permanent. In one or more embodiments, control of fluid loss for a mud may be achieved by altering the mud chemistry to improve the effectiveness of already present material in preventing fluid loss. For example, adding a clay deflocculant to freshwater mud, as one skilled in the art will be aware, may improve fluid loss control. Though method 700 has been described as specifically applying to embodiments wherein a drillpipe is set within a casing, method 700 may also be applied to any embodiment where a casing is set within a casing.

Embodiments of the present disclosure may provide at least one of the following advantages. In fluid loss events, it is prudent for operators to determine a fluid level within an annular space in order to assess the severity of the fluid loss event. A pressure change apparatus may be implemented into an existing wellbore, such that a chamber may be created within the annular space. By changing the amount of gas within the chamber, a pressure change may be measured which can be used to calculate the volume of gas within the chamber, and a fluid level within the annular space. The information garnered from determining the fluid level may be used to develop a drilling fluid loss control plan which may work to mitigate the effects of the fluid loss event on the drilling operation. The pressure change apparatus may be used continuously, alerting operators to changes in fluid level throughout the fluid loss event and, therefore, to the effectiveness of implemented mitigation methods. This continuous monitoring of fluid level allows operators to quickly address fluid loss events, such that drilling efficiency and wellbore safety may be preserved and maintained.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A method, comprising:

creating a chamber within an annulus between a wellbore casing and a drillpipe, wherein an upper boundary of the chamber comprises a seal and a lower boundary of the chamber comprises a liquid surface;

determining a volume of the chamber at a first time, wherein determining the volume of the chamber comprises:

measuring, using a pressure gauge, a first pressure within the chamber, changing an amount of a gas in the chamber using a gas pump, measuring, using the pressure gauge, a second pressure within the chamber, determining a first volume of gas within the chamber based on the first and second pressure measurements and the change in the amount of gas, and determining a first fluid level based on the first volume of the chamber.

2. The method of claim 1, further comprising:

determining a second volume of the chamber at a second time;

determining a second fluid level based on the second volume of the chamber; and determining a fluid loss by calculating a difference between the first fluid level and the second fluid level.

3. The method of claim 2, further comprising:

creating a fluid loss control plan based on the fluid loss; and executing the fluid loss control plan.

4. The method of claim 1, wherein the seal comprises an inflatable packer disposed in the annulus.

5. The method of claim 1, wherein the seal comprises a blowout preventer.

6. The method of claim 5, wherein changing an amount of gas in the chamber comprises pumping gas through a manual kill valve on the blowout preventer.

7. The method of claim 1, wherein changing an amount of gas in the chamber comprises:

installing a specialized drillpipe;

connecting a gas conduit to the specialized drillpipe; and pumping gas through the gas conduit.

8. The method of claim 7, wherein the gas conduit is a flexible gas hose.

9. The method of claim 7, wherein the pressure gauge is disposed on the gas conduit.

10. The method of claim 1, wherein the pressure gauge is disposed on the seal.

11. The method of claim 1, wherein the volume of gas within the chamber is calculated with an ideal gas equation.

12. An apparatus, comprising:

a casing disposed within a wellbore;

a drillpipe disposed within the casing, wherein an annulus is created between the casing and the drillpipe;

a seal disposed in the annulus;

a chamber, wherein an upper boundary of the chamber comprises the seal and a lower boundary of the chamber comprises a surface of a liquid;

a pressure gauge connected to the chamber;

a specialized drillpipe section threadably connected to the drillpipe; and a flexible gas hose fluidly connected to the annulus through the specialized drillpipe section.

13. The apparatus of claim 12, wherein a fluid level comprises a distance between the seal and the surface of the fluid.

14. The apparatus of claim 12, wherein the seal comprises an inflatable packer disposed in the annulus.

15. The apparatus of claim 12, wherein the seal comprises a blowout preventer.

16. The apparatus of claim 15, wherein the pressure gauge is installed on a choke line.

17. The apparatus of claim 15, wherein the pressure gauge is a digital and high frequency sampling pressure gauge.

18. The apparatus of claim 15, wherein a kill line is connected from a gas source to the blowout preventer.

19. The apparatus of claim 12, wherein a hard conduit is connected to the drillpipe.

* * * * *